US006070956A

United States Patent [19]

Yates

[11] Patent Number: 6,070,956

[45] Date of Patent: Jun. 6, 2000

[54] COMPUTER DESK WITH PIVOTING CARRIAGE

[76] Inventor: W. Shuford Yates, 881 East Hwy. 25-70, Newport, Tenn. 37821

[21] Appl. No.: 09/143,154

[22] Filed: Aug. 28, 1998

[51] Int. Cl.[7] ..... A47B 97/00; A47B 17/06

[52] U.S. Cl. ..... 312/223.3; 312/194

[58] Field of Search ..... 312/223.3, 223.6, 312/194, 195, 197, 321.5, 309, 322, 302, 303; 108/50.01, 50.02

[56] References Cited

U.S. PATENT DOCUMENTS

| | | | |
|---|---|---|---|
| 953,457 | 3/1910 | Brinker | 312/322 |
| 1,269,225 | 6/1918 | Sciannamea | 312/197 |
| 2,104,939 | 1/1938 | Whalen | 312/302 |
| 2,468,662 | 4/1949 | Glendening et al. | 312/302 |
| 2,856,252 | 10/1958 | Herring | 312/194 |
| 2,876,057 | 3/1959 | Snethen | 312/303 |
| 3,078,133 | 2/1963 | Schauer | 312/321.5 |
| 3,813,138 | 5/1974 | Doohan | 312/309 |
| 4,437,713 | 3/1984 | Roach | 312/259 |
| 4,712,842 | 12/1987 | Price et al. | 312/196 |
| 5,145,245 | 9/1992 | Fierthaler | 312/321.5 |
| 5,409,307 | 4/1995 | Forsythe | 312/194 |
| 5,518,310 | 5/1996 | Ellman et al. | 312/223.6 X |
| 5,558,418 | 9/1996 | Lambright et al. | 312/321.5 |
| 5,568,773 | 10/1996 | Hung | 108/50.02 |
| 5,584,546 | 12/1996 | Gurin et al. | 312/200 |
| 5,743,603 | 4/1998 | Kelley et al. | 312/195 |
| 5,820,238 | 10/1998 | Lambright | 312/321.5 X |
| 5,863,282 | 1/1999 | Mossun | 312/194 X |

FOREIGN PATENT DOCUMENTS

| | | | |
|---|---|---|---|
| 886322 | 1/1962 | United Kingdom | 312/194 |

*Primary Examiner*—Peter M. Cuomo
*Assistant Examiner*—James O. Hansen
*Attorney, Agent, or Firm*—Pitts & Brittian, P.C.

[57] ABSTRACT

An improved computer desk (10) having a pivoting carriage (15) for supporting a computer case. The computer desk (10) includes an upper panel (12) defining a work surface, a rear panel (14), first and second side panels (16) and (18) respectively, in spaced relation, and a pivoting carriage (15). Further a horizontal panel (20) defining a shelf depends from the rear panel (14). Proximate the second side panel (18), and in spaced relation therefrom, is a first interior panel member (22). Drawers (24) can be provided between the second side panel (18) and the first interior panel (22) as is known in the art. The carriage (15) has an open back and pivots in relation to, and independently of, the remainder of computer desk (10). When pivoted inward towards the rear panel, the carriage allows ready access to the ported side of the computer case (11). At least one port (36) is provided in rear panel (14) proximate pivoting carriage (15) in order to allow computer cables (38) to pass through rear panel (14) so as to prevent cables (38) from cluttering the knee space beneath the upper panel (12).

19 Claims, 6 Drawing Sheets

COMPUTER DESK WITH PIVOTING CARRIAGE

TECHNICAL FIELD

This invention relates to the field of office related furniture. More particularly, it relates to a desk providing a personal computer workstation.

BACKGROUND ART

The recent and rapid increase in sales of personal computers has, among other things, given rise to rapid advances in desks and other computer related work stations. And, the art is replete with desks and workstations that are designed to facilitate ergonomic and efficient placement and support of the various components of the typical personal computer. For instance, U.S. Pat. No. 5,584,546 issued on Dec. 17, 1996, to Gurin et al. discloses a transportable office work station enclosure with door and retractable casters and overhead storage for computer components. U.S. Pat. No. 5,743,603 issued on Apr. 28, 1998, to Kelley et al. discloses a furniture unit defining a closed front credenza that folds out to form an L-shaped desk. In this regard, a movable return is pivotally mounted on one side of the desk. U.S. Pat. No. 4,712,842 issued on Dec. 15, 1987, to Price et al. discloses a moveable computer work processing station having a plurality of supporting surfaces in a housing for supporting components of a personal computer. U.S. Pat. No. 5,568,773 issued on Oct. 29, 1996, to Hung discloses a multifunctional computer desk for supporting the various components of a personal computer. And, U.S. Pat. No. 5,558,418 issued on Sep. 24, 1996, to Lambright et al. discloses a furniture assembly which includes first and second desk doors which are movably mounted between open and closed positions on first and second side walls. Each of the first and second desk doors includes an edge wall and a front wall and include integral first and second cart units. The second cart unit of Lambright et al's device is adapted for receiving the computer case. Also, the computer cables in Lambright et al.'s device will occupy the knee space. While the known computer desks provide support for the components of a personal computer, it is known that access to the rear of the computer case is restricted and plugging components into or unplugging components from the computer case requires partial or complete removal of the computer case from the computer desk. And, as known by those skilled in the art, this task can be complicated by short computer cables.

What has heretofore been missing from the art is a computer desk that provides a pivoting carriage, mounted within the knee space, for storing the computer case in which the carriage pivots inward, independently of the computer desk, to allow unobstructed access to the rear, or port side, of the computer case without substantially stretching the computer cables.

Accordingly, it is an object of the present invention to provide a computer storage desk that includes a pivoting carriage, mounted within the knee space, for supporting the computer case of a personal computer.

Another object of the present invention is to provide a computer desk in which the carriage for the computer case pivots inward, independently of the computer desk, to allow user access to the port side of the computer case without substantially stretching the computer cables.

Still another object of the present invention is to provide a computer desk in which the rear panel is ported to allow computer cables to pass through the rear panel.

Other objects and advantages over the prior art will become apparent to those skilled in the art upon reading the detailed description together with the drawings as described as follows.

DISCLOSURE OF THE INVENTION

In accordance with the various features of this invention, a computer desk having a pivoting carriage is provided. The computer desk includes an upper panel defining a work surface, a rear panel, first and second side panels in spaced relation and a pivoting carriage. Further a horizontal panel defining a shelf depends from the rear panel. Proximate the second side panel, and in spaced relation therefrom, is a first interior panel member proximate the pivoting carriage. Drawers can be provided between the second side panel and the first interior panel as is known in the art.

A vertical edge panel depends from the rear panel in spaced relation from the first interior panel and terminates at the shelf. The pivoting carriage engages the vertical edge panel. In this regard, a second interior panel member is hingedly connected to the vertical edge panel and movable between an open and closed position. A floor panel depends from the second interior panel and extends between the second interior panel and the first interior panel when the second interior panel is in the closed position. The second interior panel and the floor panel define a pivoting carriage for the computer case. When pivoted inward towards the rear panel, the carriage allows ready access to the ported side of the computer case.

BEST MODE FOR CARRYING OUT THE INVENTION

Figure 1:
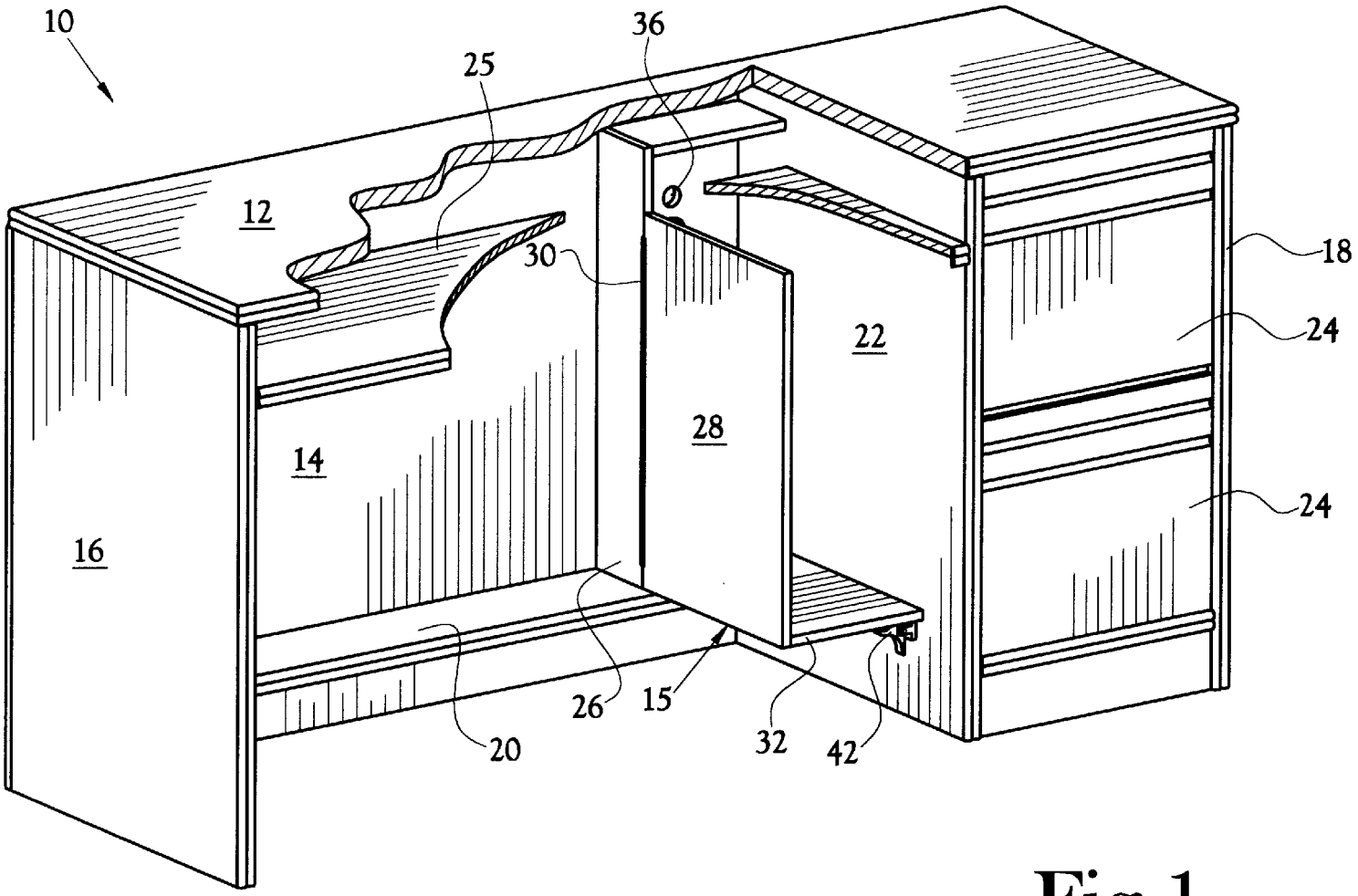
FIG. 1 illustrates a perspective view of the computer desk of the present invention with portions shown cut-away for clarity of detail.
Figure 2:
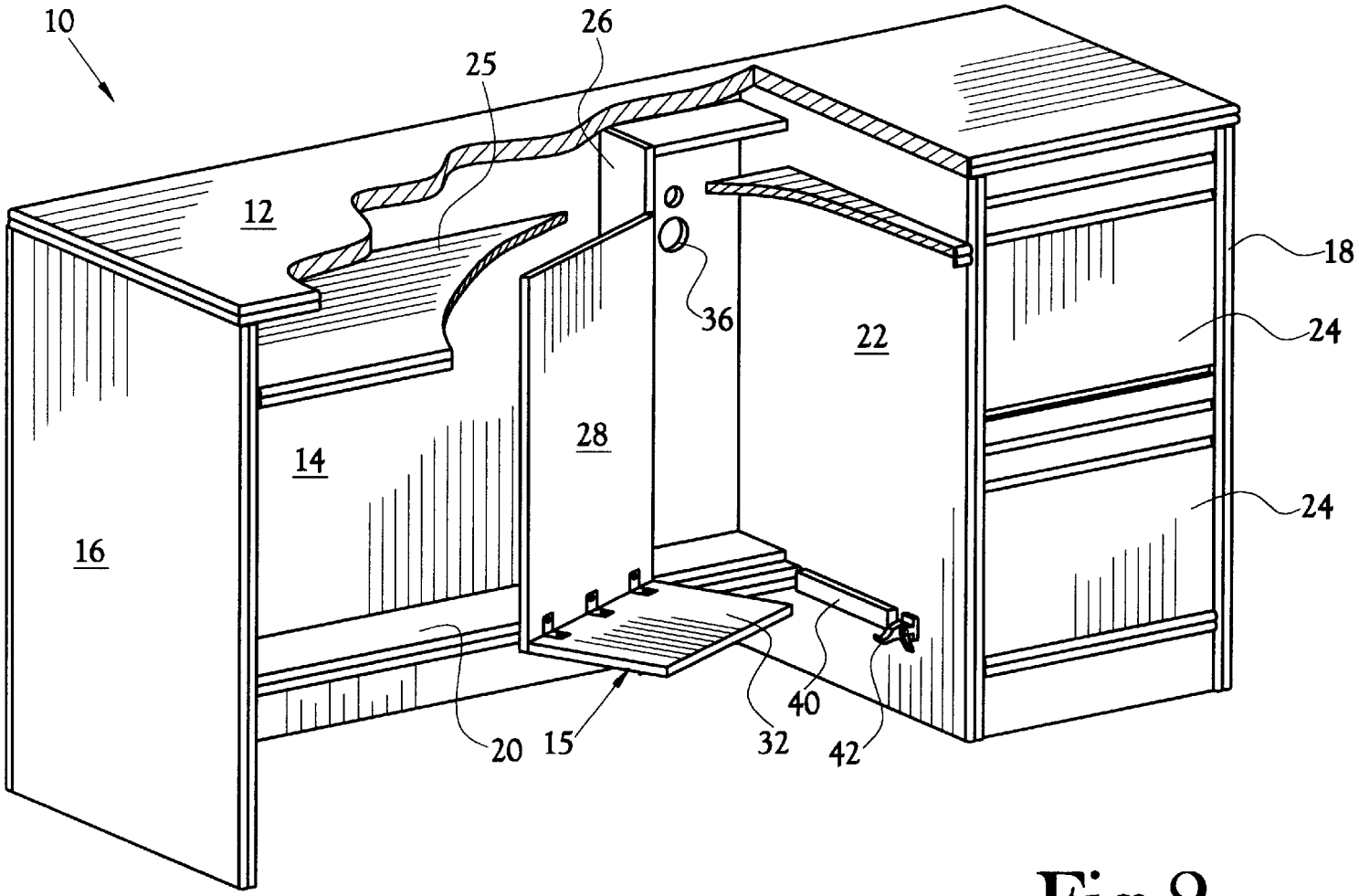
FIG. 2 illustrates a perspective view of the desk illustrated in FIG. 1 showing the carriage pivoted in the open position.
Figure 3:
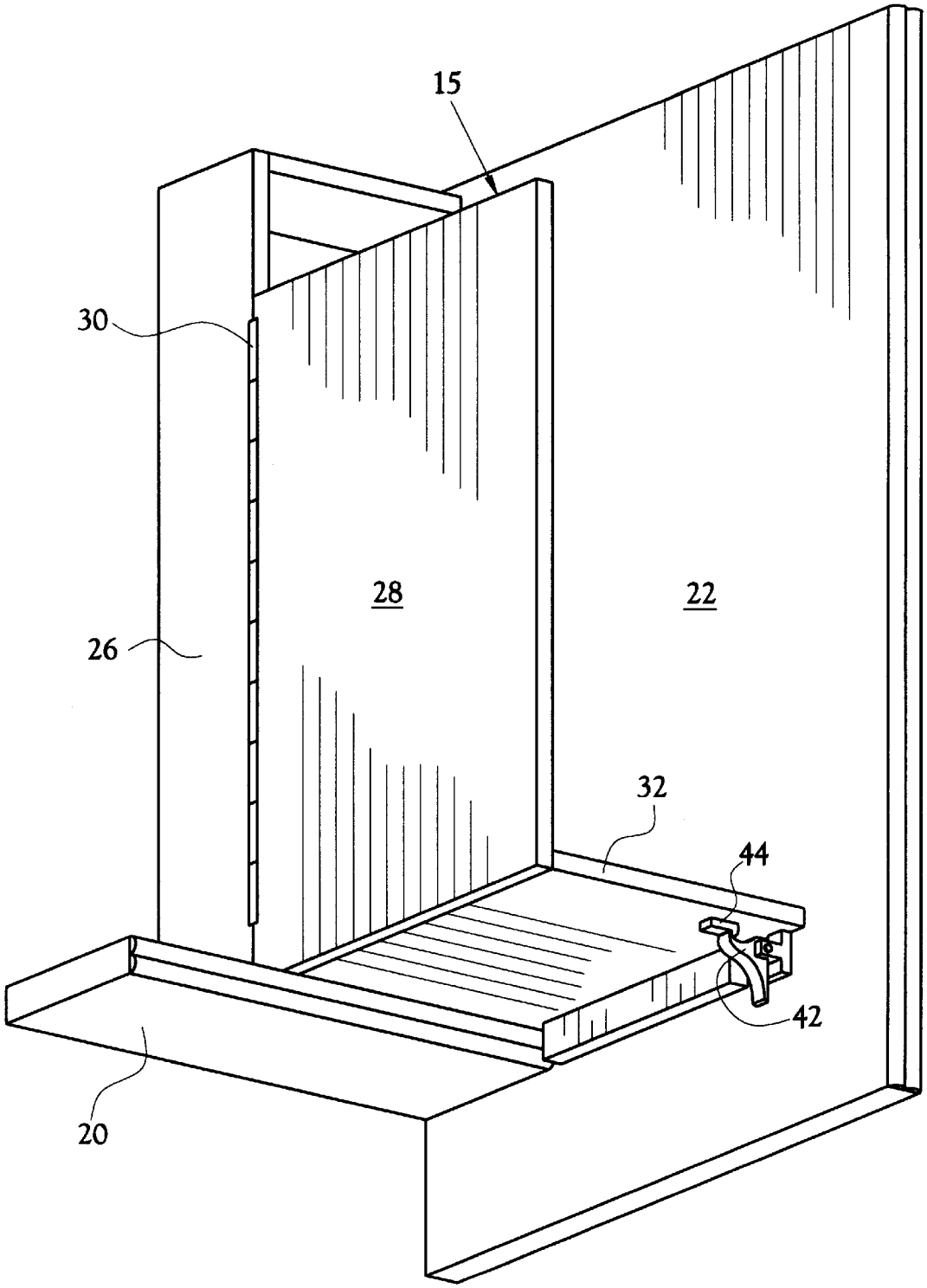
FIG. 3 is a lower perspective view, with portions removed for clarity of detail, of the lower surface of the carriage showing the release.
Figure 4:
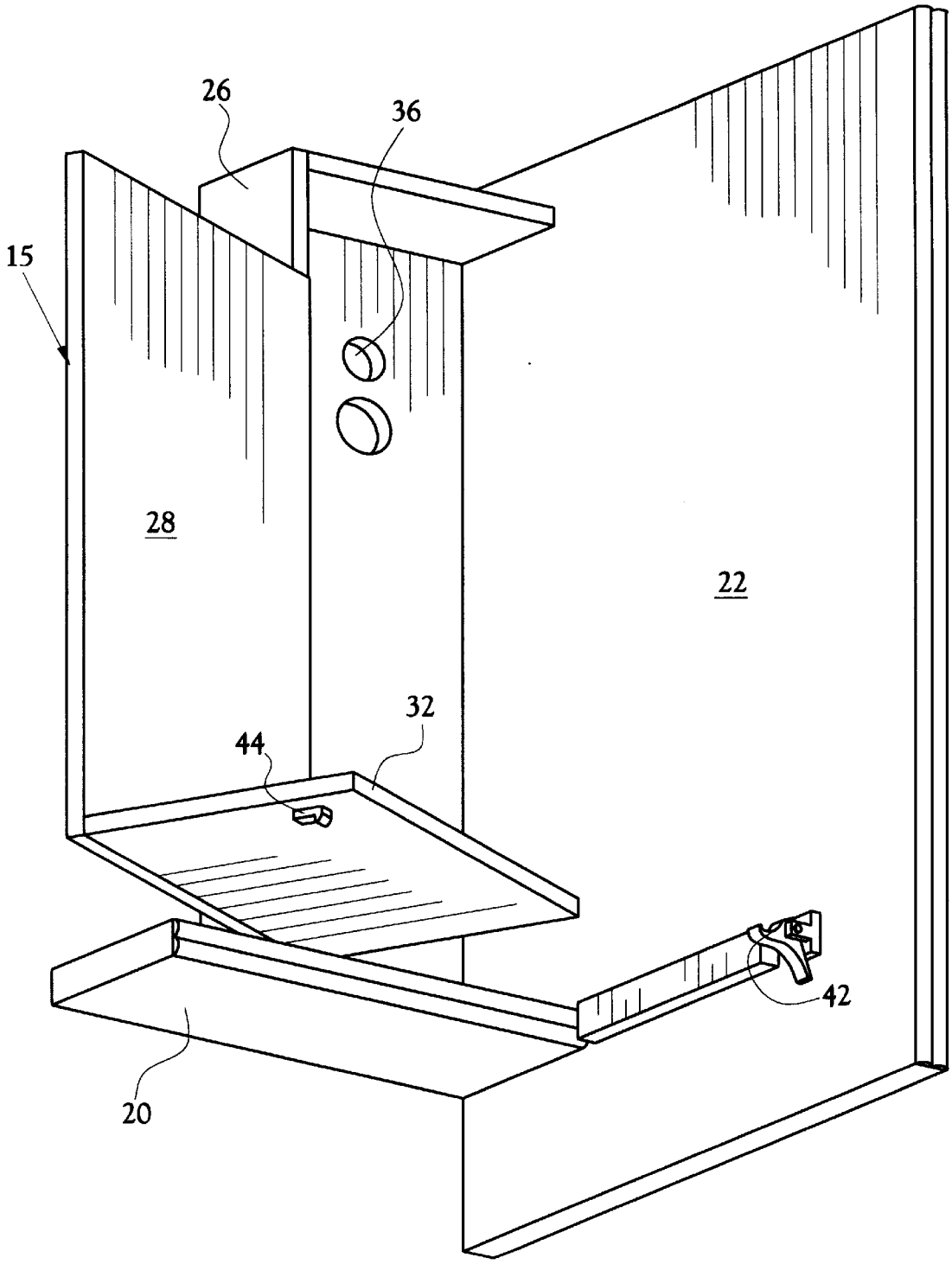
FIG. 4 is a lower perspective view, with portions removed for clarity of detail, as shown in FIG. 3 showing the carriage in the open position.
Figure 5A:
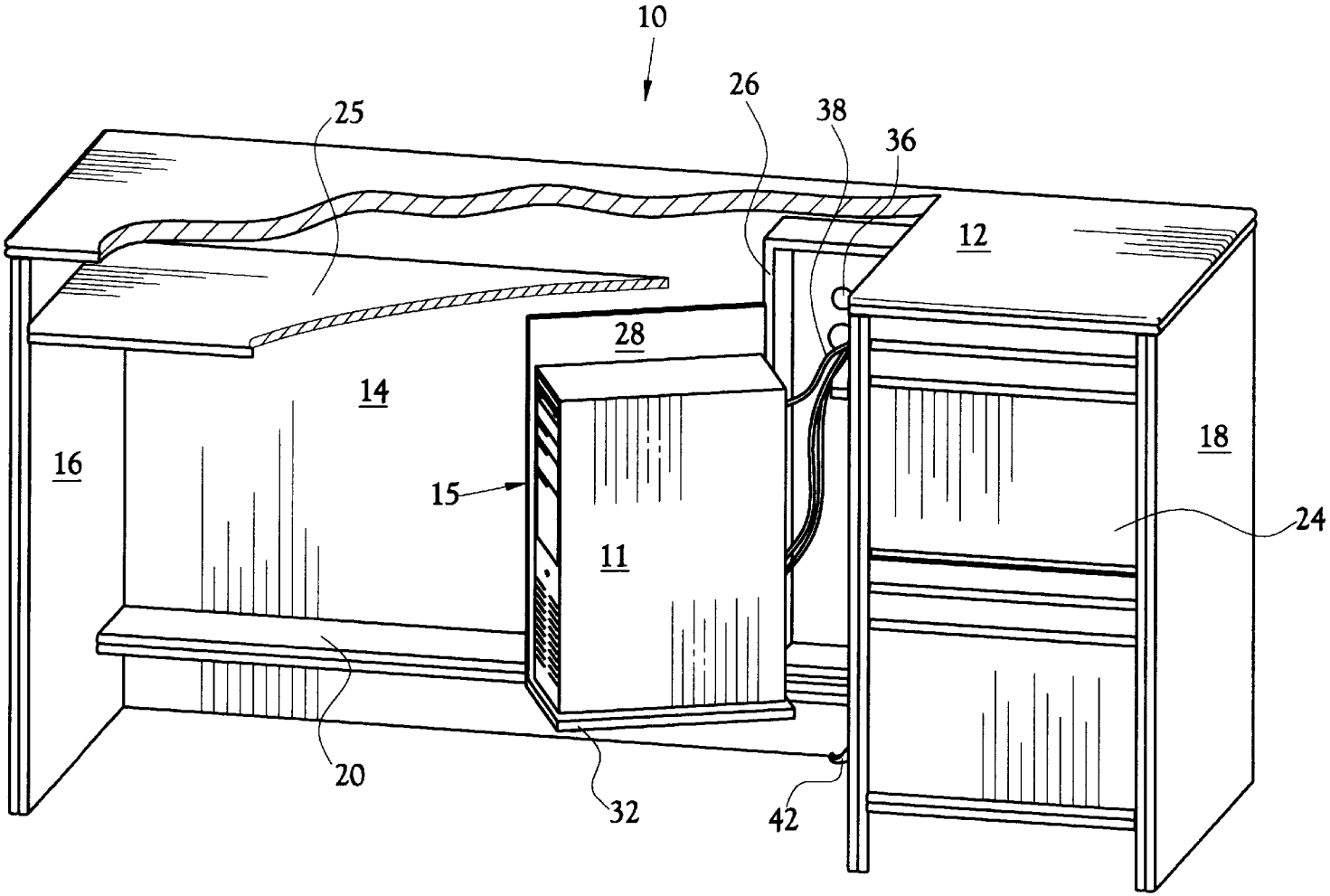
FIGS. 5A and 5B illustrate perspective views of the computer desk of the present invention, with portions removed for clarity of detail, showing access to the port side of the computer case when the carriage is in the open position.
Figure 5B:
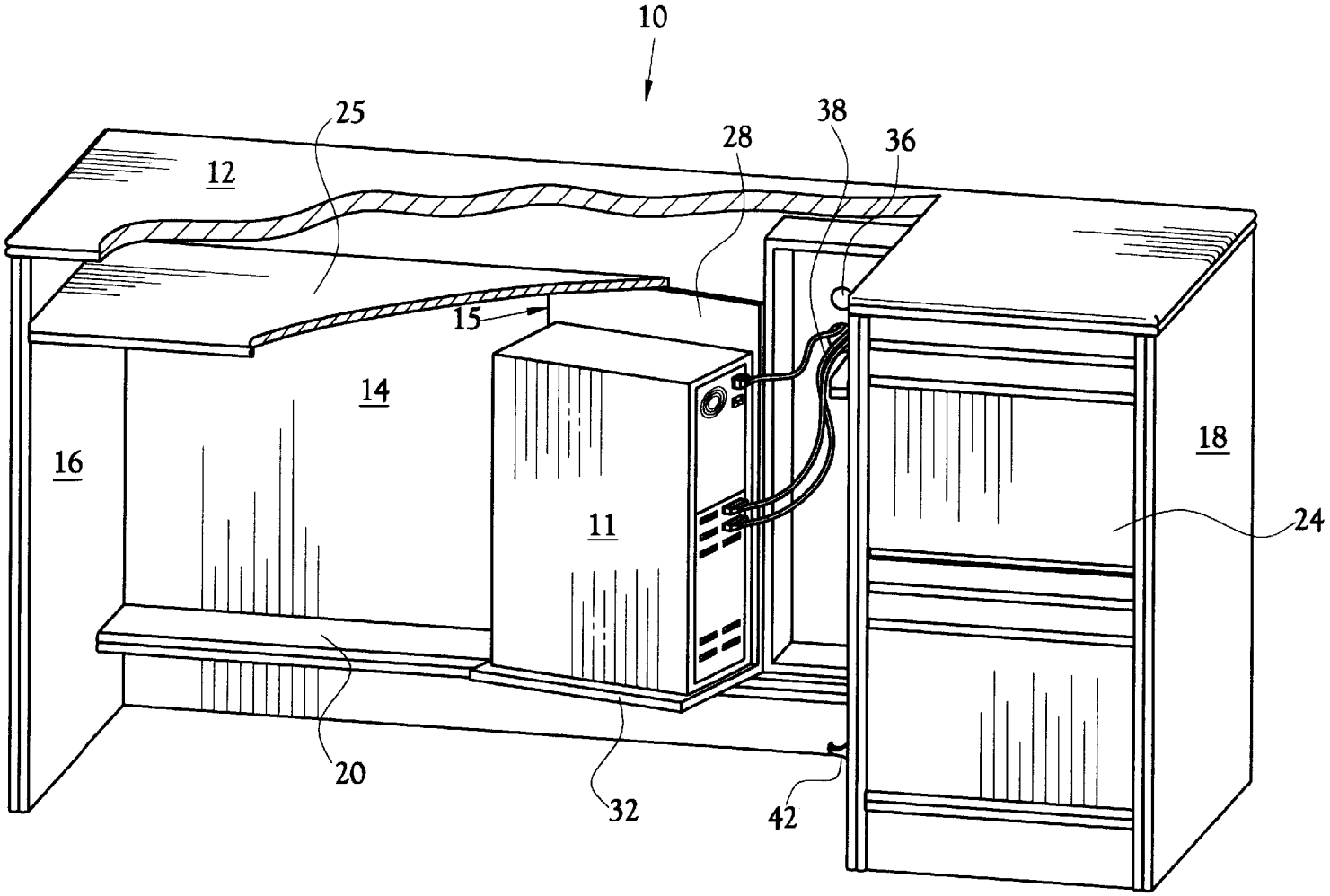

An improved computer desk having a pivoting carriage for supporting a computer case, constructed in accordance with the present invention, is illustrated generally as 10 in the figures. Those skilled in the art will recognize that the computer case 11 as referred to herein generally refers to the case that contains the logic circuits, data storage devices, I/O circuits, etc. and refers to either a "tower" configuration or "desktop" configuration, in which the desktop computer case is stood on end. The computer desk 10 includes an upper panel 12 defining a work surface, a rear panel 14, first and second side panels 16 and 18 respectively, in spaced relation, and a pivoting carriage 15. The first and second side panels 16 and 18 are, preferably, secured to the upper panel 12 and support the upper panel 12. The rear panel 14 is secured to each of the first and second side panels 16 and 18.

Further a horizontal panel 20 defining a shelf depends from the rear panel 14. Proximate the second side panel 18, and in spaced relation therefrom, is a first interior panel member 22. Drawers 24 can be provided between the second side panel 18 and the first interior panel 22 as is known in the art. Additional drawers (not shown) can be provided proximate the first end panel 16 if desired. Further, a state of the art sliding keyboard tray 25 can be disposed just below the upper panel 12.

A vertical edge panel 26 depends from the rear panel 14 in spaced relation from the first interior panel 22 and terminates at the shelf 20. The pivoting carriage 15 engages the vertical edge panel 26 and pivots about a vertical axis. In this manner, the carriage 15 pivots in relation to, and independently of, the remainder of computer desk 10. In this regard, the pivoting carriage 15 has an open back and includes a second interior panel member 28 that is hingedly connected to the vertical edge panel 26 and movable between an open and closed position. In the preferred embodiment, a full length piano hinge 30 is used. However, those skilled in the art will recognize that other types of hinges could be utilized. A floor panel 32 depends from the second interior panel 28 and extends between the second interior panel 28 and the first interior panel 18 when the carriage 15 is in the closed position. In the preferred embodiment a plurality of angle braces 34 are secured both to the second interior panel 28 and the floor panel 32 in order to provide support to floor panel 32. When pivoted inward towards the rear panel, the carriage allows ready access to the ported side of the computer case 11. At least one port 36 is provided in rear panel 14 proximate pivoting carriage 15 in order to allow computer cables 38 to pass through rear panel 14 so as to prevent cables 38 from cluttering the knee space beneath the upper panel 12.

In order to provide additional support for floor panel 32 when the pivoting carriage 15 is in the closed position, a brace 40 depends from and is secured to the first interior panel 22 proximate floor panel 32 and positioned such that floor panel 32 engages and is supported by the brace 40 when the pivoting carriage 15 is in the closed position. Further, when fully opened, the floor panel 32 engages and is supported by horizontal panel 20. Additionally, in the preferred embodiment a latch 42 and cooperating latch plate 44 are provided. In the preferred embodiment, latch 42 is secured to the first interior panel 22 and the cooperating latch plate 44 is secured to the bottom of the floor panel 32.

From the foregoing description, it will be recognized by those skilled in the art that a computer desk having a pivoting carriage for supporting a computer case, offering advantages over the prior art has been provided. Specifically, the computer desk provides a computer storage desk that includes a pivoting carriage for supporting the computer case of a personal computer, mounted within the knee space, and in which the carriage for the computer case pivots inward, independently of the computer desk, to allow user access to the port side of the computer case without substantially stretching the computer cables. In the preferred embodiment, the computer desk has a ported rear panel to allow passage of various computer cables through the rear panel.

While a preferred embodiment has been shown and described, it will be understood that it is not intended to limit the disclosure, but rather it is intended to cover all modifications and alternate embodiments falling within the spirit and the scope of the invention as defined in the appended claims.

I claim:

1. A computer desk adapted to support a computer case, said computer desk comprising:

an upper panel defining a work surface;

first and second side panels in spaced relation secured to said upper panel;

a rear panel secured to said first and second side panels;

a carriage member carried by said computer desk, said carriage member having an open front and an open back, wherein said carriage member is adapted to pivot in relation to said computer desk and is movable between a closed position and an open position such that said open front is readily accessible from a front of said computer desk when said carriage member is in said closed position and said open back is readily accessible from said front of said computer desk when said carriage member is in said open position: and a vertical edge panel depending from said rear panel and disposed between said first and second side panels wherein said carriage member is hingedly engaged with said vertical edge panel.

2. The computer desk of claim 1 wherein said computer desk further comprises a horizontal panel defining a shelf, wherein said horizontal panel depends from said rear panel.

3. The computer desk of claim 1 wherein said computer desk further comprises a first interior panel in spaced relation from said second side panel wherein desk drawers are disposed between said first interior panel and said second side panel.

4. The computer desk of claim 1 wherein said carriage member is engaged to said vertical edge panel by a piano hinge.

5. The computer desk of claim 1 wherein said rear panel includes at least one port proximate said carriage member.

6. The computer desk of claim 1 wherein said computer desk further comprises a latch for selectively securing said carriage member in said closed position.

7. A computer desk adapted to support a computer cases said computer desk comprising:

an upper panel defining a work surface;

first and second side panels in spaced relation secured to said upper panel;

a rear panel secured to said first and second side panels; and a carriage member carried by said computer desk, said carriage member having an open front and an open back, wherein said carriage member is adapted to pivot in relation to said computer desk and is movable between a closed position and an open position such that said open front is readily accessible from a front of said computer desk when said carriage member is in said closed position and said open back is readily accessible from said front of said computer desk when said carriage member is in said open position, wherein said carriage member is defined by an interior panel and a floor panel wherein said floor panel depends from said interior panel.

8. The computer desk of claim 7 wherein said floor panel extends between said second interior panel and said first interior panel when said carriage member is in said closed position.

9. A computer desk adapted to support a computer case, said computer desk comprising:

an upper panel defining a work surface;

first and second side panels in spaced relation secured to said upper panel;

a rear panel secured to said first and second side panels;

a first interior panel in spaced relation from said second side panel wherein desk drawers are disposed between said first interior panel and said second side panel;

a vertical edge panel depending from said rear panel and in spaced relation from said first interior panel; and a carriage member hingedly engaged with said vertical edge panel, said carriage member having an open front and an open back, wherein said carriage member is adapted to pivot in relation to said computer desk and is movable between a closed position and an open position such that said open front is readily accessible from a front of said computer desk when said carriage member is in said closed position and said open back is readily accessible from a front of said computer desk when said carriage member is in said open position.

10. The computer desk of claim 9 wherein said computer desk further comprises a horizontal panel defining a shelf, wherein said horizontal panel depends from said rear panel.

11. The computer desk of claim 9 wherein said carriage member is engaged to said vertical edge panel by a piano hinge.

12. The computer desk of claim 9 wherein said carriage member is defined by a second interior panel and a floor panel wherein said floor panel depends from said second interior panel.

13. The computer desk of claim 12 wherein said floor panel extends between said second interior panel and said first interior panel when said carriage member is in said closed position.

14. The computer desk of claim 13 wherein said computer desk further comprises a brace depending from said first interior panel wherein said brace is positioned so as to engage and support said carriage member when said carriage member is in said closed position.

15. The computer desk of claim 9 wherein said rear panel includes at least one port proximate said carriage member.

16. The computer desk of claim 9 wherein said computer desk further comprises a latch for selectively securing said carriage member in said closed position.

17. A computer desk adapted to support a computer case, said computer desk comprising:

an upper panel defining a work surface;

first and second side panels in spaced relation secured to said upper panel;

a rear panel secured to said first and second side panels;

a first interior panel in spaced relation from said second side panel wherein desk drawers are disposed between said first interior panel and said second side panel;

a vertical edge panel depending from said rear panel and in spaced relation from said first interior panel;

a carriage member hingedly engaged with said vertical edge panel, said carriage member having an open front and an open back, wherein said carriage member is adapted to pivot in relation to said computer desk and is movable between a closed position and an open position such that said open front is readily accessible from a front of said computer desk when said carriage member is in said closed position and said open back is readily accessible from said front of said computer desk when said carriage member is in said open position, wherein said carriage member is defined by a second interior panel and a floor panel wherein said floor panel depends from said second interior panel; and a brace depending from said first interior panel wherein said brace is positioned so as to engage and support said carriage member when said carriage member is in said closed position.

18. The computer desk of claim 17 wherein said computer desk further comprises a latch for selectively securing said carriage member in said closed position.

19. A computer desk adapted to support a computer case, said computer desk comprising:

an upper panel defining a work surface;

first and second side panels in spaced relation secured to said upper panel;

a first interior panel in spaced relation from said second side panel wherein desk drawers are disposed between said first interior panel and said second side panel a rear panel secured to said first and second side panels;

a carriage member defined by a second interior panel and a floor panel depending from said second interior panel carried by said computer desk, said carriage member having an open back, wherein said carriage member is adapted to pivot in relation to said computer desk and is movable between a closed position and an open position wherein open front is readily accessible from a front of said computer desk when said carriage member is in said closed position and said open back is readily accessible from said front of said computer desk when said carriage member is in said open position, and further wherein said floor panel extends between said second interior panel and said first interior panel when said carriage member is in said closed position; and a brace depending from said first interior panel wherein said brace is positioned so as to engage and support said carriage member when said carriage member is in said closed position.

* * * * *